US009782984B2

(12) United States Patent
Koshimura et al.

(10) Patent No.: US 9,782,984 B2
(45) Date of Patent: Oct. 10, 2017

(54) PRINTER

(71) Applicant: FUJITSU COMPONENT LIMITED, Tokyo (JP)

(72) Inventors: Katsuaki Koshimura, Tokyo (JP); Masahiro Kaneko, Tokyo (JP); Nobuo Yatsu, Tokyo (JP); Yayoi Tokuhara, Tokyo (JP); Kohei Takahashi, Tokyo (JP); Chuqi Liang, Tokyo (JP); Miki Kitahara, Tokyo (JP); Kiwa Imai, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 15/166,393

(22) Filed: May 27, 2016

(65) Prior Publication Data

US 2016/0355033 A1 Dec. 8, 2016

(30) Foreign Application Priority Data

Jun. 2, 2015 (JP) ..... 2015-112609

(51) Int. Cl.

| | |
|---|---|
| ***B65H 3/06*** | (2006.01) |
| ***B41J 11/04*** | (2006.01) |
| ***B65H 5/06*** | (2006.01) |

(52) U.S. Cl.

CPC ..... *B41J 11/04* (2013.01); *B65H 5/06* (2013.01); *B65H 2403/20* (2013.01); *B65H 2403/82* (2013.01); *B65H 2404/16* (2013.01)

(58) Field of Classification Search

CPC . F16H 3/363; F16H 9/10; F16H 55/54; F16H 55/24; B65H 3/06; B62M 9/16; B62M 9/08

USPC ..... 474/47, 49, 54; 271/109

See application file for complete search history.

(56) References Cited

U.S. PATENT DOCUMENTS

| | | | | | |
|---|---|---|---|---|---|
| 157,150 | A * | 11/1874 | Brand | F16H 55/54 | 474/54 |
| 563,399 | A * | 7/1896 | Musgreave | F16H 9/10 | 474/53 |
| 1,438,307 | A * | 12/1922 | Hopper | F16H 3/363 | 74/349 |
| 2,552,179 | A * | 5/1951 | Kamp | F16H 9/10 | 474/53 |
| 6,656,070 | B2 * | 12/2003 | Tay | F16H 9/10 | 474/53 |
| 7,448,292 | B2 * | 11/2008 | Tomizawa | F16H 15/22 | 74/349 |
| 9,334,944 | B2 * | 5/2016 | Appleton | F16H 55/54 | |
| 2009/0074496 | A1 * | 3/2009 | Mori | B26D 1/385 | 400/120.01 |

FOREIGN PATENT DOCUMENTS

| | | |
|---|---|---|
| JP | H06-039445 U | 5/1994 |
| JP | 2002-370411 | 12/2002 |

* cited by examiner

*Primary Examiner* — Thomas Morrison
(74) *Attorney, Agent, or Firm* — IPUSA, PLLC

(57) ABSTRACT

A printer includes a platen roller, a first pulley connected to the shaft of the platen roller, a motor, a second pulley connected to the shaft of the motor, and a belt wrapped around the first pulley and the second pulley. At least one of the first pulley and the second pulley has a variable diameter.

7 Claims, 19 Drawing Sheets

PRINTER

CROSS-REFERENCE TO RELATED APPLICATION

The present application is based upon and claims the benefit of priority of Japanese Patent Application No. 2015-112609, filed on Jun. 2, 2015, the entire contents of which are incorporated herein by reference.

BACKGROUND OF THE INVENTION

1. Field of the Invention

The present invention relates to printers.

2. Description of the Related Art

Printers are widely used for shop registers and automated teller machines (ATMs) or cash dispensers (CDs) in banks.

According to such printers, a platen roller is rotated to convey recording paper. (See, for example, Japanese Laid-Open Utility Model Application No. 6-39445 and Japanese Laid-Open Patent Application No. 2002-370411.)

SUMMARY OF THE INVENTION

According to an aspect of the present invention, a printer includes a platen roller, a first pulley connected to the shaft of the platen roller, a motor, a second pulley connected to the shaft of the motor, and a belt wrapped around the first pulley and the second pulley. At least one of the first pulley and the second pulley has a variable diameter.

According to an aspect of the present invention, a printer includes a platen roller, a first pulley connected to the shaft of the platen roller, a motor, a second pulley connected to the shaft of the motor, and a third pulley that contacts the first pulley and the second pulley. The periphery of the first pulley and the periphery of the second pulley are sloped to taper the first pulley and the second pulley in opposite axial directions. The third pulley is configured to move on the sloped periphery of the first pulley and the sloped periphery of the second pulley, so as to change the rotational speed of the platen roller.

DESCRIPTION OF THE EMBODIMENTS

Figure 1A:
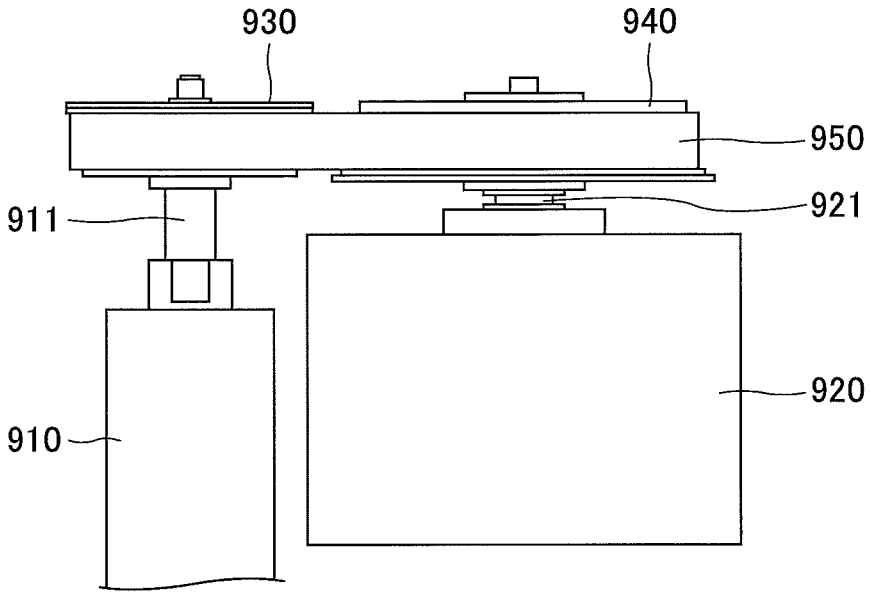
FIGS. 1A and 1B are diagrams depicting a motor and a platen roller.
Figure 1B:
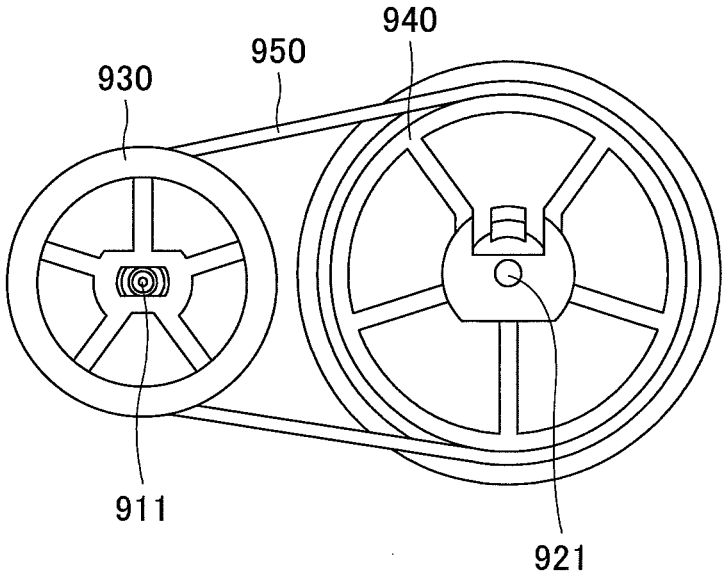

According to some printers, a platen roller is rotated by the rotation of a motor transmitted to the platen roller through a belt. FIGS. 1A and 1B are a plan view and a side view, respectively, of the mechanism of a printer that transmits the rotation of a motor to a platen roller. As depicted in FIGS. 1A and 1B, a belt 950 is wrapped around and between a pulley 930 attached to a rotating shaft 911 of a platen roller 910, and a pulley 940 attached to a rotating shaft 921 of a stepper motor 920 (hereinafter "motor"). When the motor 920 rotates, the pulley 940 rotates to rotate the pulley 930 via the belt 950, so that the rotation of the pulley 930 is transmitted to the platen roller 910.

In some cases, it is required to change the speed of conveying recording paper to perform printing in a single printer. For example, the conveying speed may be changed by changing the rotational speed of the motor 920. This method, however, is not preferable because an increase in operating noise due to the low-speed pulse driving of the motor 920 and the degradation of print quality due to a reverse movement of the motor 920 at the time of its stepping are caused, in addition to heat dissipation and an increase in power consumption due to the low-speed operation of the motor 920.

Alternatively, the conveying speed may be changed by changing a combination of mating gears by providing a gear box for changing the rotational speed of the platen roller 910. This method, however, is not preferable because the necessity of a gear box increases the size and cost of the printer.

According to an aspect of the present invention, a small-size, low-cost printer that changes the conveying speed without degradation of print quality is provided.

Embodiments of the present invention are described below with reference to accompanying drawings. In the following description, the same elements are referred to using the same reference numeral, and a description thereof is not repeated.

[a] First Embodiment

A printer according to a first embodiment is described below.

Figure 2:
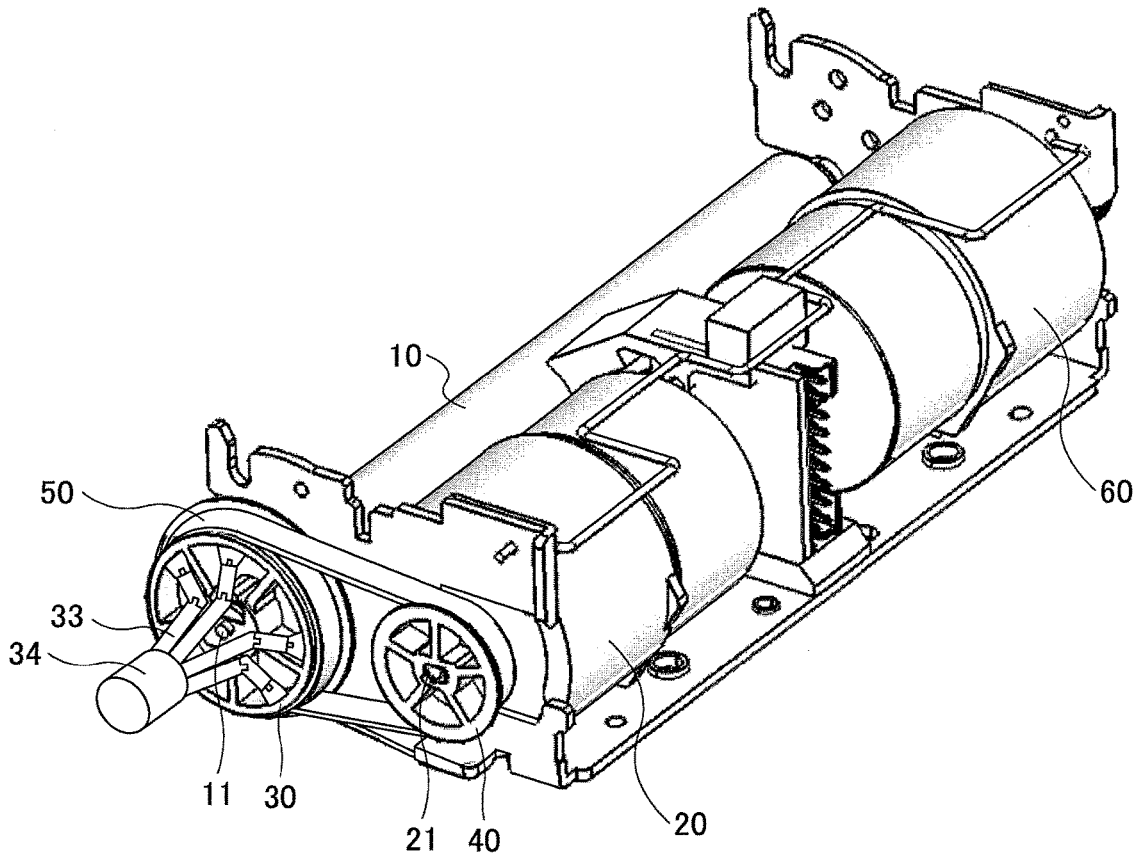
FIG. 2 is a diagram depicting a printer according to a first embodiment.

FIG. 2 is a diagram depicting a printer according to the first embodiment. Referring to FIG. 2, the printer includes a platen roller 10 and a motor 20. The printer further includes a first pulley 30 attached to a shaft 11 of the platen roller 10, a second pulley 40 attached to a shaft 21 of the motor 20, and a belt 50 wrapped around the periphery of the first pulley 30 and the periphery of the second pulley 40. Accordingly, when the motor 20 rotates, the second pulley 40 rotates to rotate the first pulley 30 via the belt 50, so that the platen roller 10 rotates.

A thermal head (not illustrated) is pressed against the platen roller 10. The platen roller 10 rotates to convey recording paper, and printing is performed on the recording paper. Furthermore, the printer may include a cutter (not depicted) that cuts the recording paper, and a motor 60 that drives the cutter.

Figure 3:
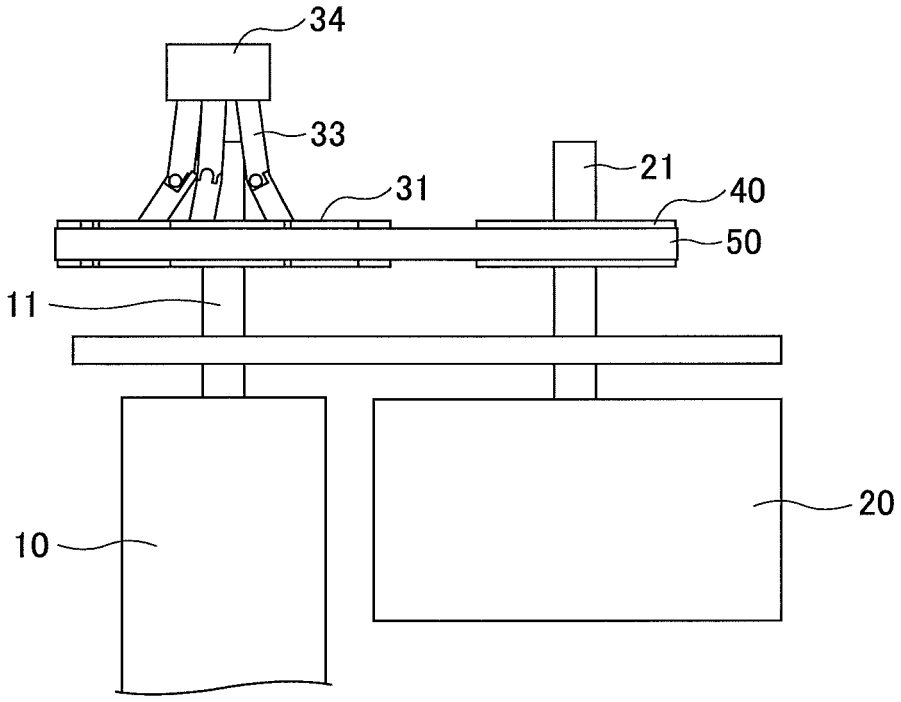
FIG. 3 is a bottom view of the printer according to the first embodiment.

The printer is described in more detail with reference to FIGS. 2, 3, 4A and 4B. FIG. 3 is a bottom view of the printer, and FIGS. 4A and 4B are exterior side views of the printer.

The first pulley 30 includes a pulley frame (hereinafter "frame") 31, diameter extension parts (hereinafter, "extension parts") 32, arms 33, and a push-button switch 34. The frame 31 has a substantially circular shape. The extension parts 32 are movably provided on the frame 31 to spread radially outward from the frame 31, to increase the diameter of the first pulley 30. Each of the extension parts 32 is connected to a first end of one of the arms 33. A second end of each of the arms 33 is connected to the switch 34. The switch 34 is positioned on the extension of the axis of the shaft 11. The belt 50 wrapped around the first pulley 30 contacts a belt contact portion 32*b*, described below with reference to FIG. 8, of each extension part 32. The extension parts 32 and the arms 33 are formed of a metal or resin material. The belt 50 is formed of an elastic material, such as rubber. The number of extension parts 32 and the number of arms 33 provided in the first pulley 30 may be, but are not limited to, five as depicted in FIGS. 4A and 43. Preferably, the number of extension parts 32 is three or more.

Figure 4A:
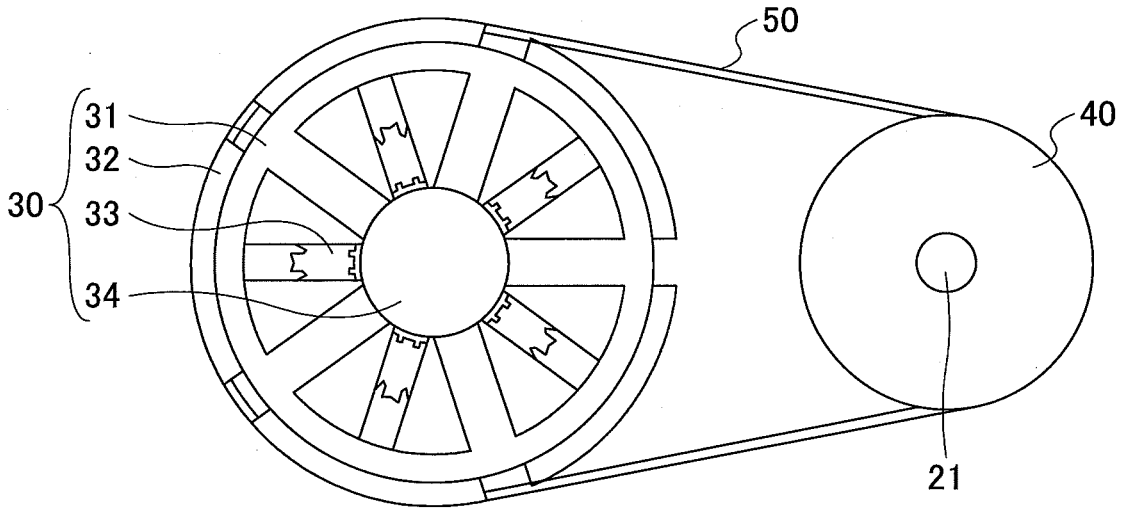
FIGS. 4A and 4B are exterior side views of the printer according to the first embodiment.
Figure 4B:
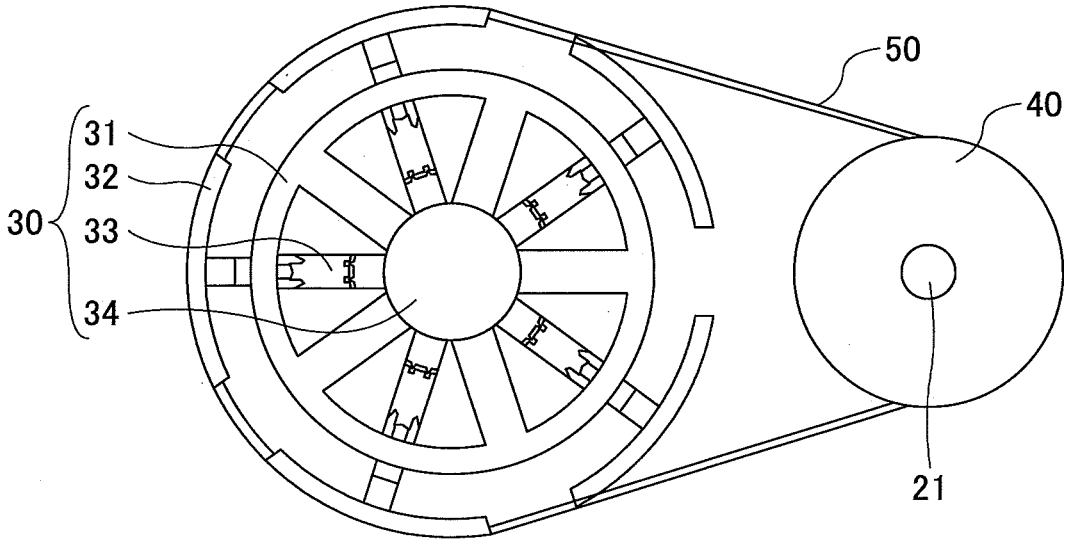

According to this embodiment, when the switch 34 is not pressed, the extension parts 32 are in contact with the periphery of the frame 31 as depicted in FIG. 4A. In this state, the diameter of the first pulley 30 is, for example, 30 mm. When the switch 34 is pressed, the arms 33 connected to the switch 34 move radially outward with respect to the center of the first pulley 30, as depicted in FIG. 4B. Consequently, the extension parts 32 connected to the arms 33 are detached from the periphery of the frame 31 to move radially outward. In the state depicted in FIG. 4B, the diameter of the first pulley 30 is, for example, 40 mm. Thus, the extension parts 32 radially extend the periphery of the first pulley 30.

The diameter of the second pulley 40 attached to the shaft 21 of the motor 20 is, for example, 20 mm. When the diameter of the first pulley 30 is 30 mm, the conveying speed by the rotation of the platen roller 10 is, for example, 50 mm/s.

On the other hand, when the switch 34 is pressed to spread the extension parts 32 outward, so that the diameter of the first pulley 30 becomes 40 mm, the conveying speed becomes, for example, 37.5 mm/s without changing the rotational speed of the motor 20.

That is, according to this embodiment, it is possible to change the conveying speed by changing the diameter of the first pulley 30 by pressing the switch 34 to spread the extension parts 32 outward. In the case of increasing the conveying speed in the state depicted in FIG. 4B, the switch 34 is pressed again to return to its original state. As a result, as depicted in FIG. 4A, the extension parts 32 are returned to their original positions by the tension of the belt 50 to reduce the diameter of the first pulley 30.

According to this embodiment, the switch 34 is pressed once to project the arms 33 outward and support the arms 33 in the projected state, and is pressed again to retract the arms 33 to their original positions.

Figure 5:
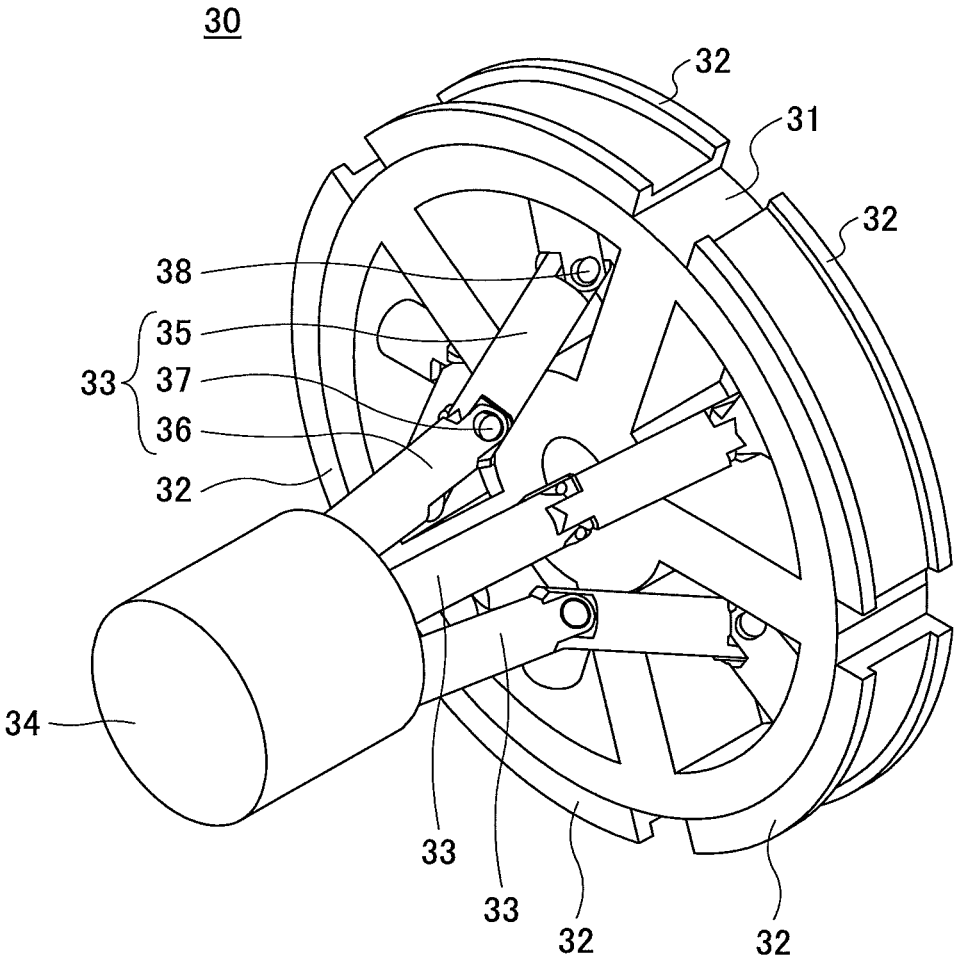
FIG. 5 is a perspective view of a pulley according to the first embodiment.
Figure 6:
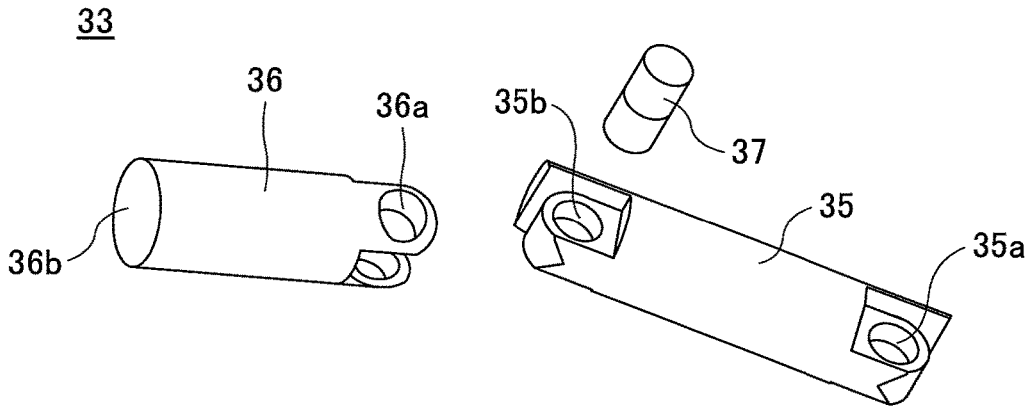
FIG. 6 is an exploded perspective view of an arm according to the first embodiment.
Figure 7:
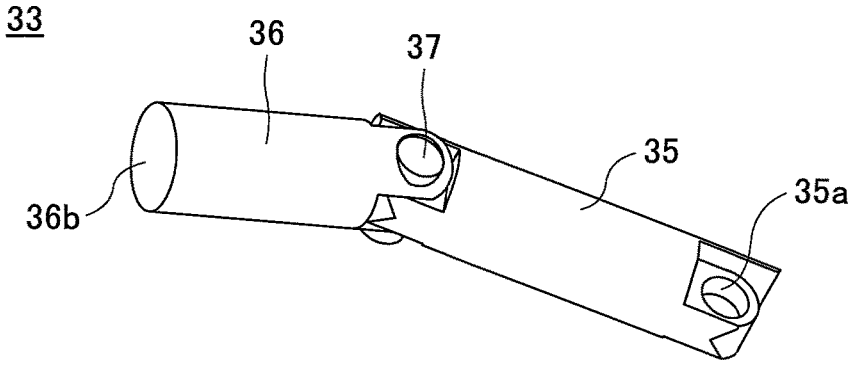
FIG. 7 is a perspective view of the arm according to the first embodiment.
Figure 8:
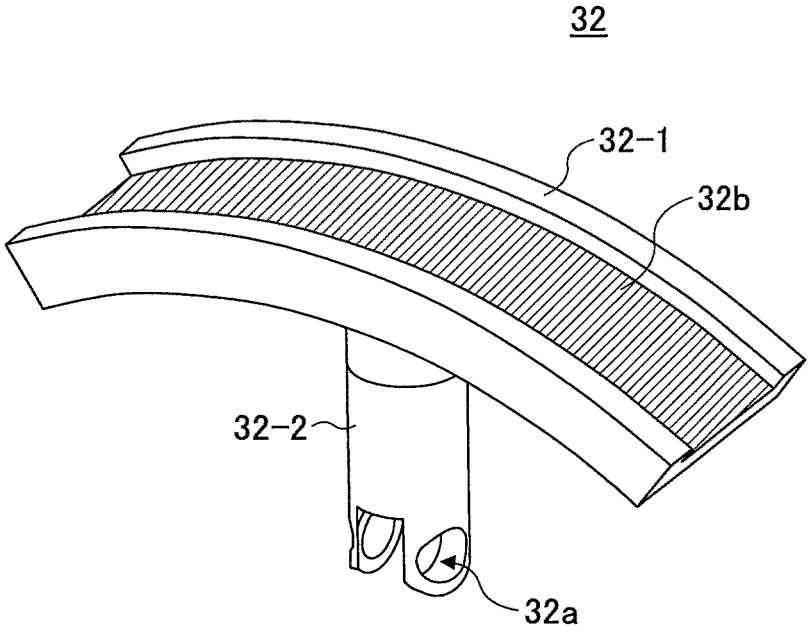
FIG. 8 is a perspective view of an extension part according to the first embodiment.

Next, the first pulley 30 is described in more detail with reference to FIGS. 5 through 8. FIG. 5 is a perspective view of the first pulley 30. FIG. 6 is an exploded perspective view of the arm 33. FIG. 7 is a perspective view of the arm 33. FIG. 8 is a perspective view of the extension part 32.

Referring to FIGS. 5 through 7, each of the arms 33 includes a first member 35 and a second member 36. A through hole 35*a* is formed in the first member 35 near its first end, and a through hole 35*b* is formed in the first member 35 near its second end opposite to the first end. Furthermore, through holes 36*a* are formed in the second member 36 near its first end. The through holes 35*b* and 36*a* are connected by a columnar joint 37 to allow the second member 36 to rotate relative to the first member 35. A second end 36*b* of the second member 36 opposite to its first end is connected to the switch 34.

Referring to FIG. 8, each of the extension parts 32 includes an arcuate body 32-1 and an extension arm 32-2 extending inward from the arcuate body 32-1. Through holes 32*a* are formed in the extension arm 32-2 near its end opposite to the arcuate body 32-1. The through hole 35*a* formed in the first member 35 is connected to the through holes 32*a* by a columnar joint 38 depicted in FIG. 5, to allow the first member 35 to rotate relative to the extension arm 32-2. The exterior of the arcuate body 32-1 is grooved to form the contact portion 32*b*, which contacts the belt 50.

According to this embodiment, the switch 34 is pressed to move the second members 36 toward the frame 31. As a result, the first members 35 rotate about the joints 37 to press the extension parts 32 outward. Consequently, the extension parts 32 radially slide and spread outward from the first pulley 30, so that the diameter of the first pulley 30 is increased and the conveying speed is reduced.

While the diameter of the first pulley 30 is changed as described in this embodiment, the diameter of the second pulley 40 may alternatively be changed.

[b] Second Embodiment

Figure 9:
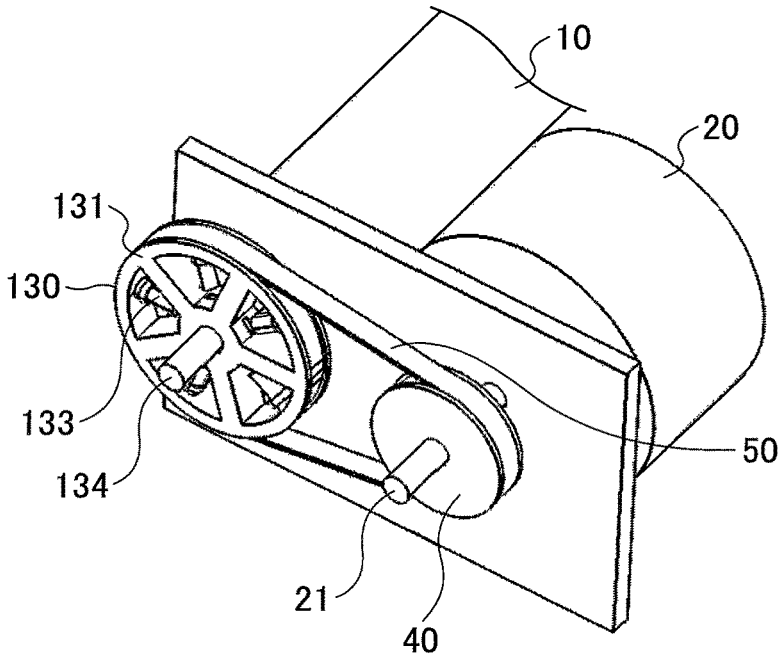
FIG. 9 is a perspective view of a printer according to a second embodiment.
Figure 10A:
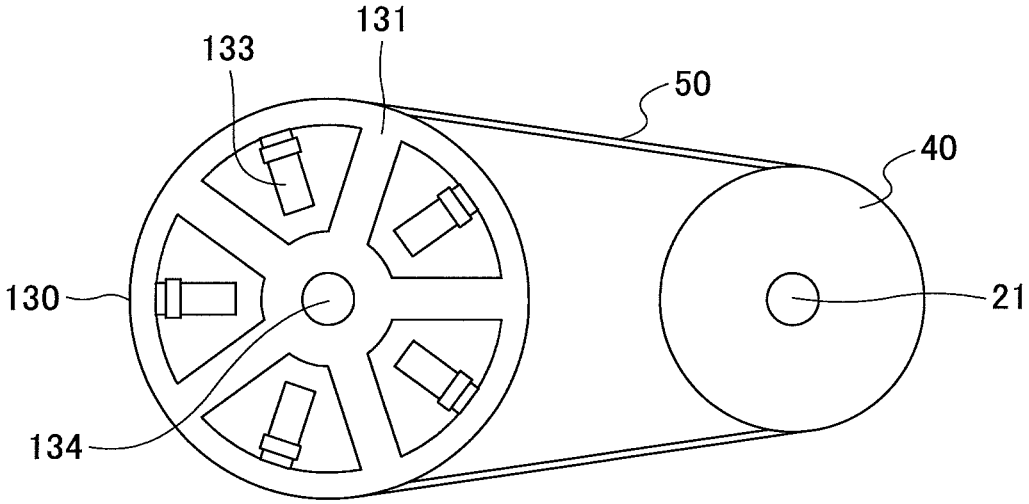
FIGS. 10A and 10B are exterior side views of the printer according to the second embodiment.
Figure 11A:
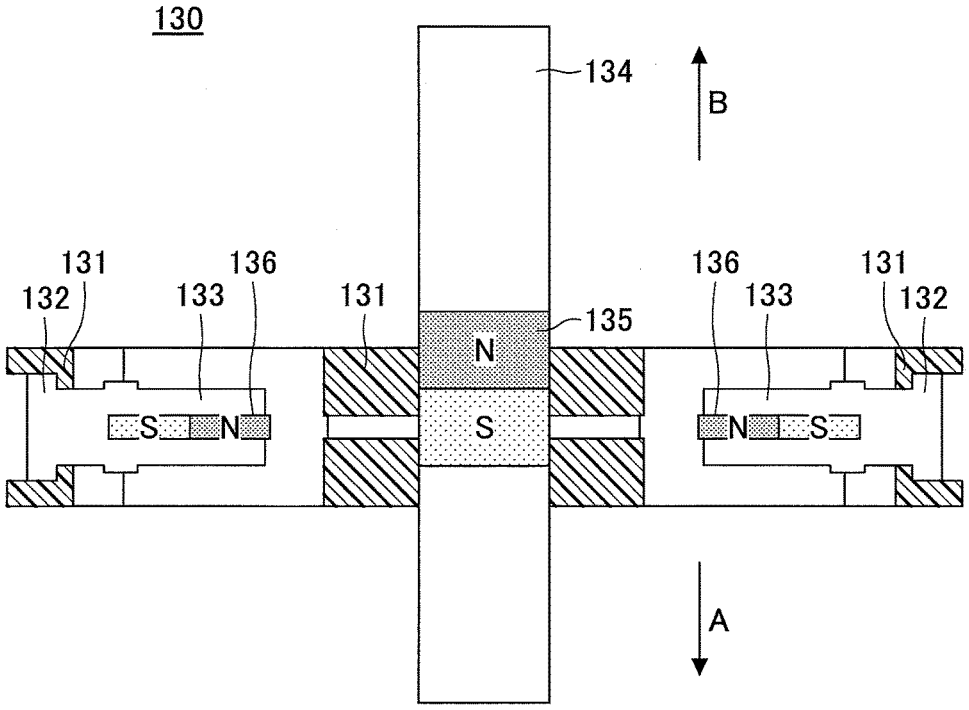
FIGS. 11A and 11B are diagrams depicting a pulley according to the second embodiment.
Figure 11B:
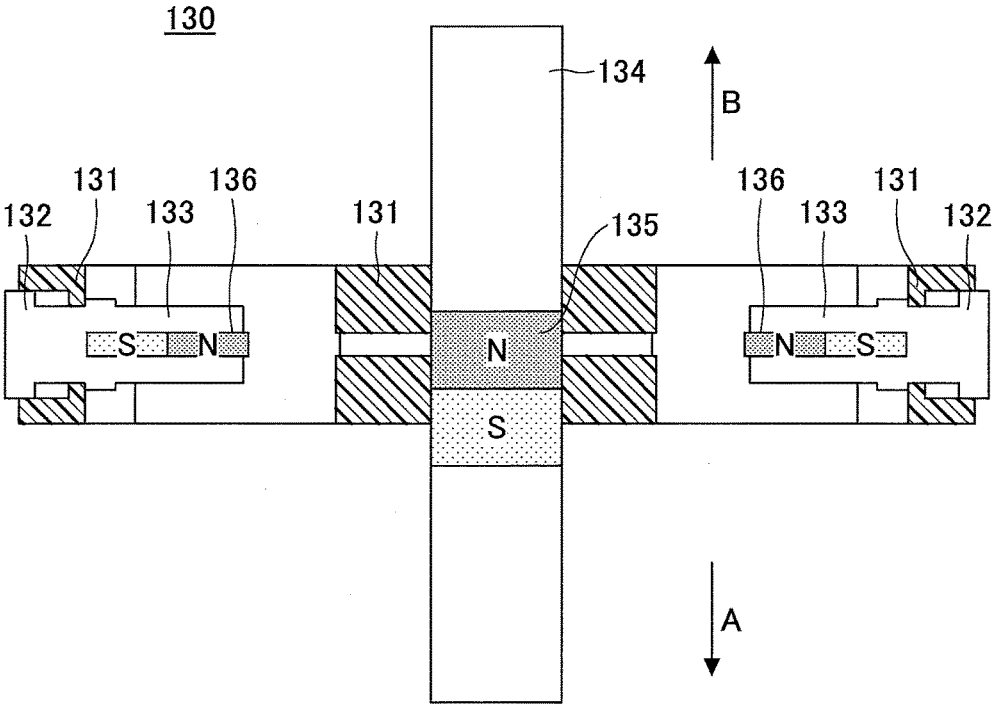

Next, a second embodiment is described. FIG. 9 is a perspective view of a printer according to this embodiment. FIGS. 10A and 103 are exterior side views of the printer. FIGS. 11A and 11B are cross-sectional views of a first pulley 130.

Referring to FIG. 9, similar to the first embodiment, the printer of this embodiment includes the platen roller 10 and the motor 20. The first pulley 130 is attached to the shaft 11 of the platen roller 10. The second pulley 40 is attached to the shaft 21 of the motor 20. The belt 50 is wrapped around the first pulley 130 and the second pulley 40.

When the motor 20 rotates, the second pulley 40 rotates to rotate the first pulley 130 via the belt 50, so that the platen roller 10 rotates.

Figure 10B:
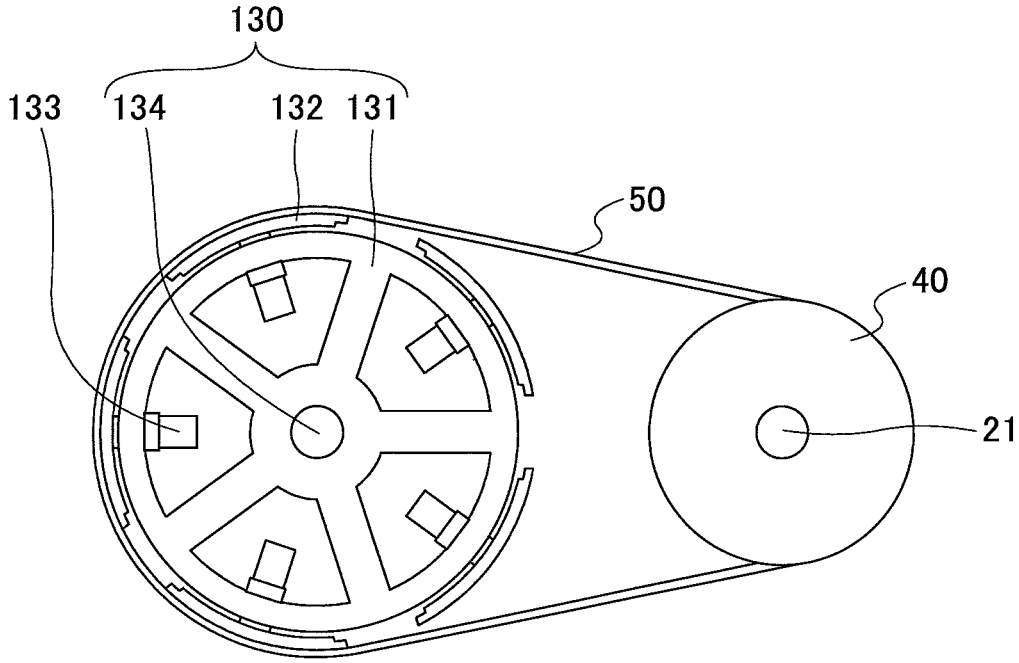

The printer is described in more detail with reference to FIGS. 9, 10A and 10B. The first pulley 130 includes a frame 131, extension parts 132, and a shaft 134. A push-button switch is provided at an end of the shaft 134. The frame 131 has a substantially circular shape. The extension parts 132 are provided on the frame 131, with respective supports 133 extending inward (toward the center of the first pulley 130) from the extension parts 132. The extension parts 132 are attached to the frame 131 with the supports 133 being slidable in the radial direction of the first pulley 130. The shaft 134 is provided through the rotation center of the first pulley 130.

As depicted in FIGS. 11A and 11B, the shaft 134 is movable along the axis of the frame 131. That is, the shaft 134 is movable in the direction toward the platen roller 10 indicated by arrow A, and in the direction away from the platen roller 10 indicated by arrow B. The directions of the axis of the frame 131 may be hereinafter collectively referred to as "the axial direction." A permanent magnet 135 is incorporated in the shaft 134, with the north pole and the south pole of the magnet 135 being positioned outside and inside relative to each other, respectively, in the axial direction. Furthermore, a permanent magnet 136 is incorporated in each of the supports 133, with the north pole and the south pole of the magnet 136 being positioned radially inside and outside relative to each other, respectively, with respect to the center of the first pulley 130.

According to this embodiment, when the switch provided on the shaft 134 is not pressed, the south pole of the magnet 135 is positioned at the center of the frame 131 and the north pole of the magnet 135 is positioned outside relative to the south pole in the axial direction, as depicted in FIG. 11A. In this state, the south pole of the magnet 135 and the north poles of the magnets 136 attract each other. As a result, the extension parts 132 contact the frame 131, so that the first pulley 130 has the smaller diameter, as depicted in FIG. 10A.

When the switch is pressed toward the platen roller 10, the north pole of the magnet 135 is positioned at the center of the frame 131, and the south pole moves inward in the axial direction, as depicted in FIG. 11B. In this state, the north pole of the magnet 135 and the north poles of the magnets 136 repel each other. As a result, the extension parts 132 move radially outward relative to the center of the first pulley 130, so that the first pulley 130 has the larger diameter, as depicted in FIG. 10B.

When the shaft 134 returns to its original state depicted in FIG. 10A, the south pole of the magnet 135 is positioned at the center of the frame 131 to attract the north poles of the magnets 136. As a result, the extension parts 132 move in a direction to contact the frame 131, so that the first pulley 130 has the smaller diameter, as depicted in FIGS. 10A and 11A.

According to this embodiment, the conveying speed may be changed by spreading the extension parts 132 to enlarge the diameter of the first pulley 130 by pressing the switch. The number of extension parts 132 may be, but are not limited to, five as depicted in FIGS. 9 through 11B. Preferably, the number of extension parts 132 is three or more. In other respects than those described above, the second embodiment may be the same as the first embodiment.

[c] Third Embodiment

Figure 12:
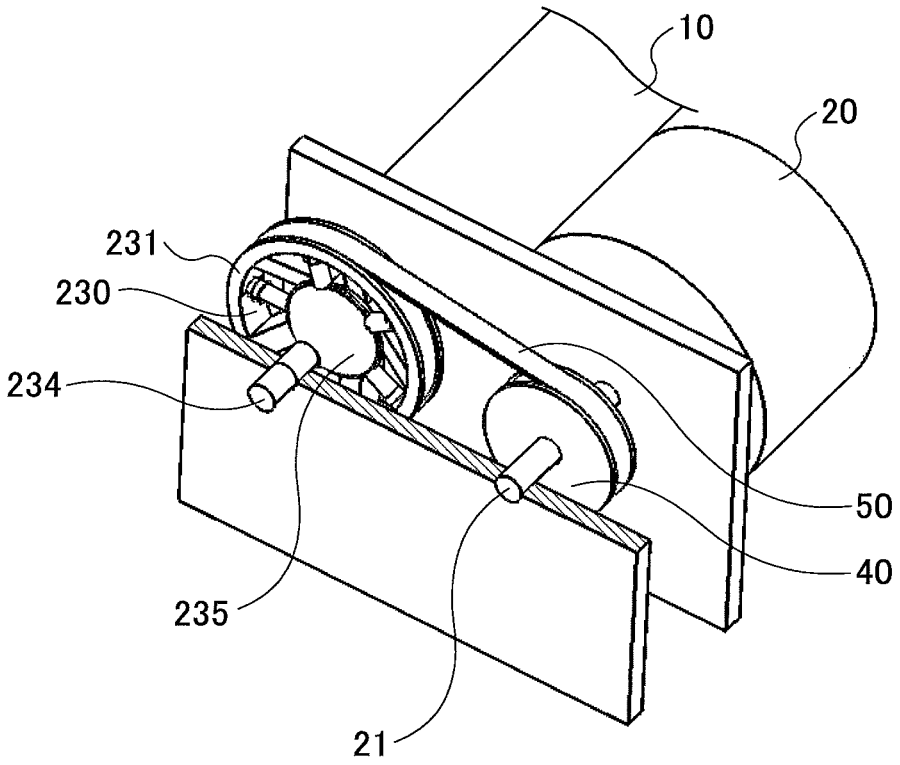
FIG. 12 is a perspective view of a printer according to a third embodiment.
Figure 13:
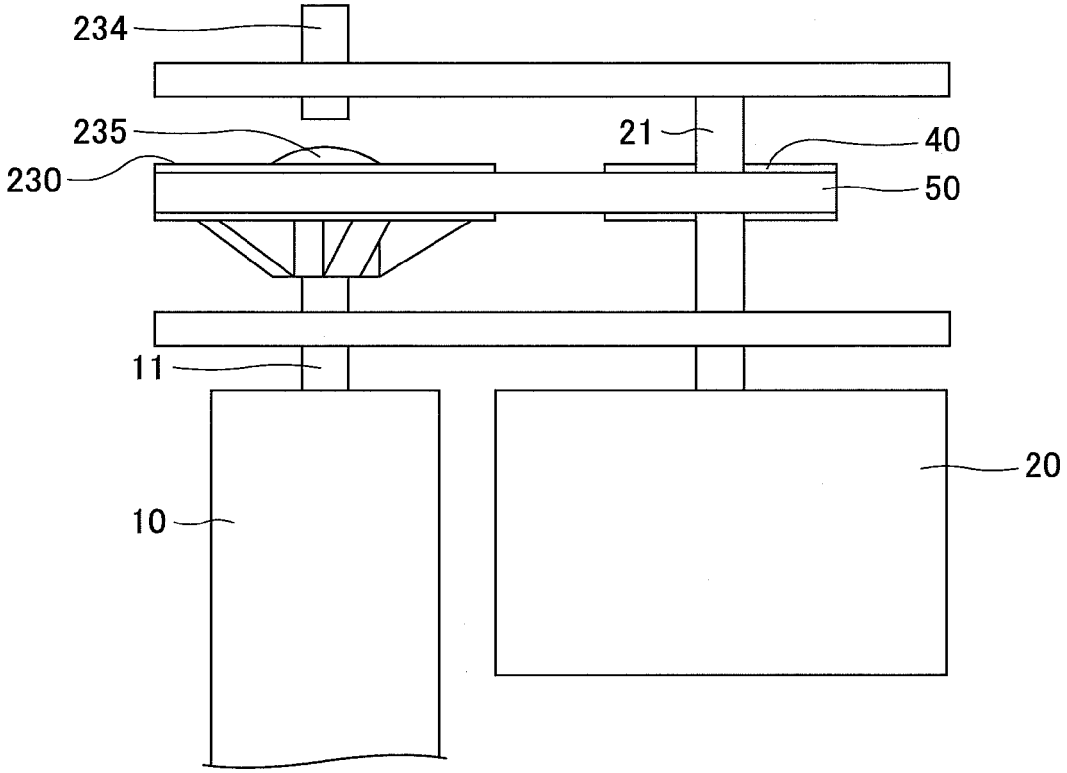
FIG. 13 is a bottom view of the printer according to the third embodiment.
Figure 14A:
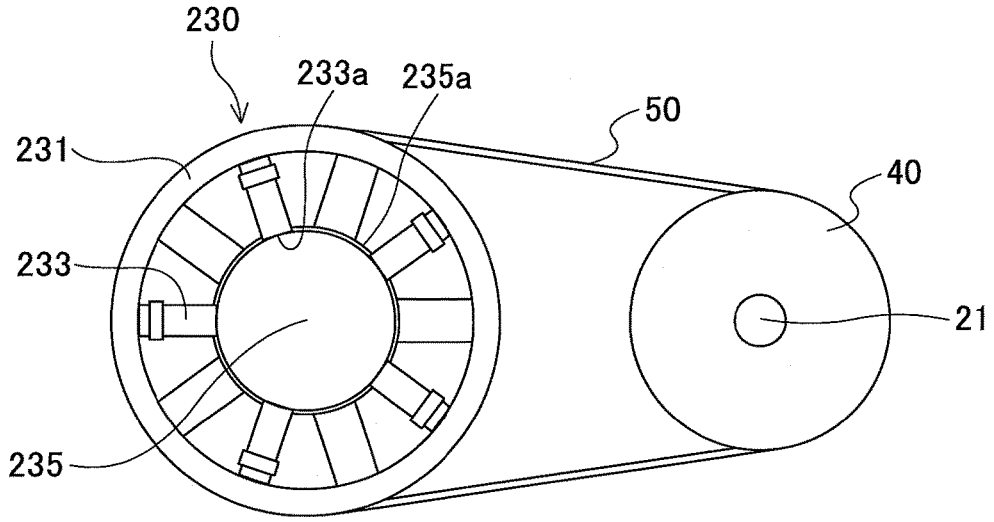
FIGS. 14A and 14B are exterior side views of the printer according to the third embodiment.
Figure 14B:
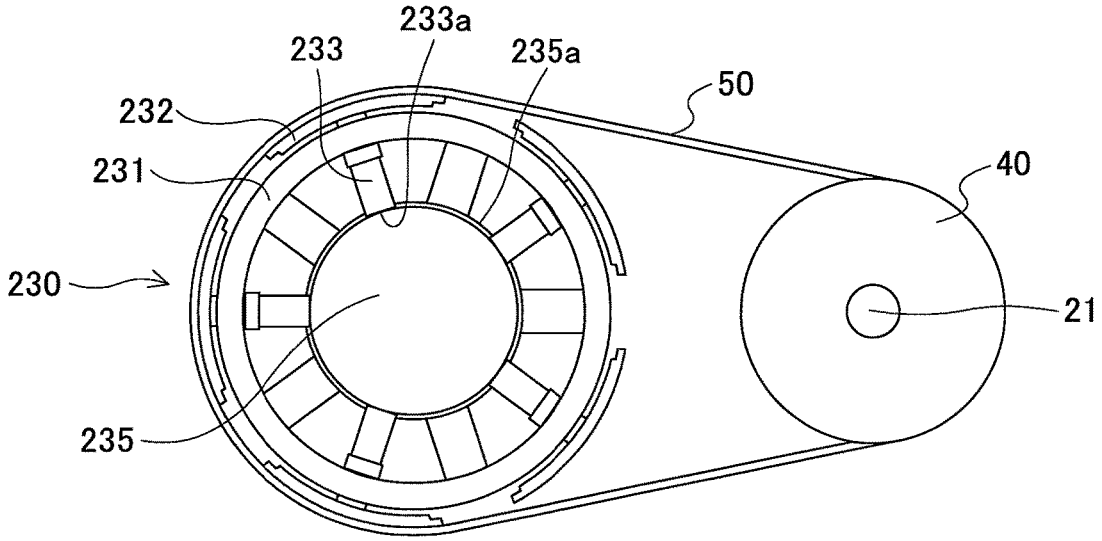
Figure 15A:
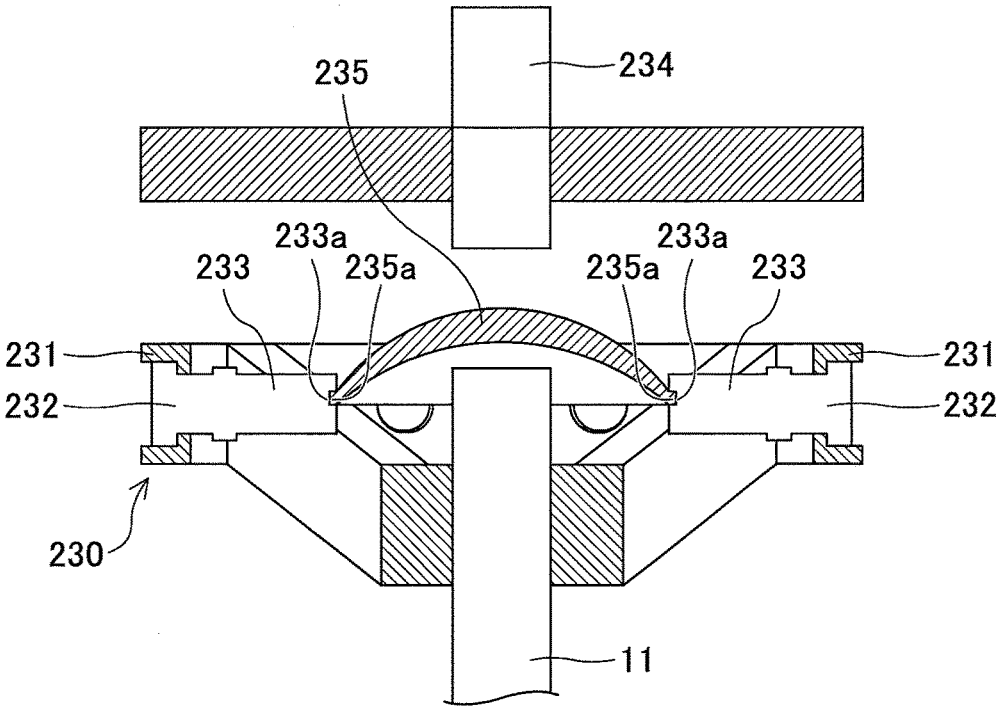
FIGS. 15A and 15B are diagrams depicting a pulley according to the third embodiment.

Next, a third embodiment is described. FIG. 12 is a perspective view of a printer according to this embodiment. FIG. 13 is a bottom view of the printer. FIGS. 14A and 14B are exterior side views of the printer. FIGS. 15A and 13B are cross-sectional views of a first pulley 230.

Referring to FIGS. 12 and 13, the printer of this embodiment includes the platen roller 10 and the motor 20. The first pulley 230 is attached to the shaft 11 of the platen roller 10. The second pulley 40 is attached to the shaft 21 of the motor 20. The belt 50 is wrapped around the first pulley 230 and the second pulley 40.

When the motor 20 rotates, the second pulley 40 rotates to rotate the first pulley 230 via the belt 50, so that the platen roller 10 rotates.

The printer of this embodiment is described in more detail with reference to FIGS. 14A through 15B. The first pulley 230 includes a circular-shaped frame 231, extension parts 232, and a metal dome 235 provided in the center of the frame 231. The extension parts 232 are attached to the frame 231 to be movable radially outward from the frame 231. The extension parts 232 are provided with respective supports 233 that extend inward from the extension parts 232. The extension parts 232 are attached to the frame 231 with the supports 233 being slidable in the radial direction of the first pulley 230. Inner ends 233*a* of the supports 233 contact a periphery 235*a* of the metal dome 235. Furthermore, a push-button switch 234 to press the center of the metal dome 235 is positioned on the shaft 11.

According to this embodiment, when the switch 234 is not pressed, the switch 234 is out of contact with the metal dome 235, as depicted in FIG. 15A. Therefore, the extension parts 232 contact the frame 231, so that the first pulley 230 has the smaller diameter, as depicted in FIG. 14A.

Figure 15B:
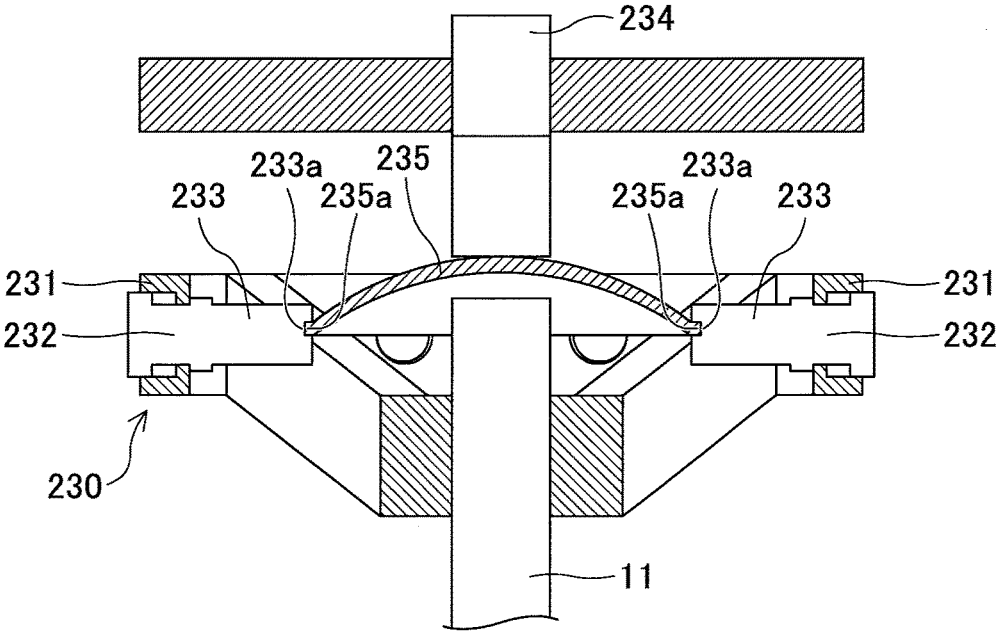

When the switch 234 is pressed, the center of the metal dome 235 is pressed by the switch 234 to spread the periphery 235*a* outward. As a result of the spreading of the periphery 235*a* of the metal dome 235, the inner ends 233*a* of the supports 233 which are in contact with the periphery 235*a* are pressed outward. Consequently, the extension parts 232 spread radially outward, so that the diameter of the first pulley 230 increases, as depicted in FIGS. 14B and 15B. When the switch 234 returns to its original state, the metal dome 235 receives no pressing force from the switch 234. Accordingly, the metal dome 235 returns to its original state, so that the first pulley 230 returns to having the smaller diameter, as depicted in FIGS. 14A and 15A.

According to this embodiment, the conveying speed may be changed by changing the diameter of the first pulley 230 which is increased or decreased by the extension parts 232 when the switch 234 is pressed. The number of extension parts 232 may be, but are not limited to, five as depicted in FIGS. 12 through 15B. Preferably, the number of extension parts 232 is three or more. In other respects than those described above, the third embodiment may be the same as the first embodiment.

[d] Fourth Embodiment

Figure 16:
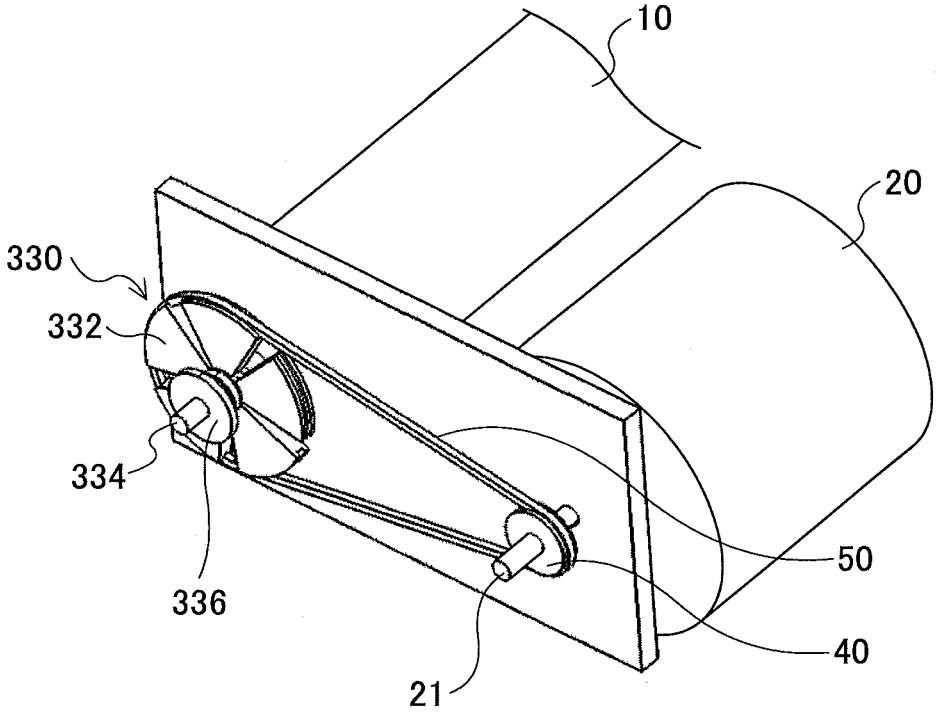
FIG. 16 is a perspective view of a printer according to a fourth embodiment.
Figure 17A:
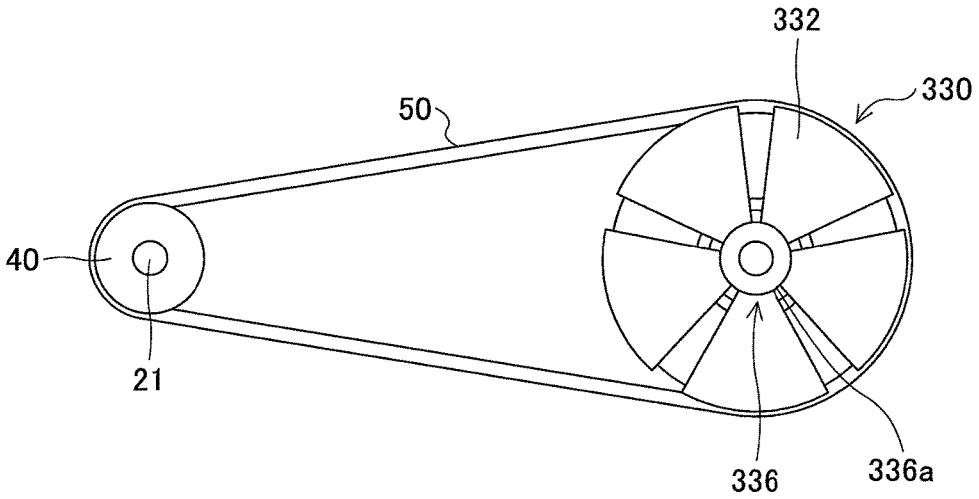
FIGS. 17A and 17B are interior side views of the printer according to the fourth embodiment.
Figure 17B:
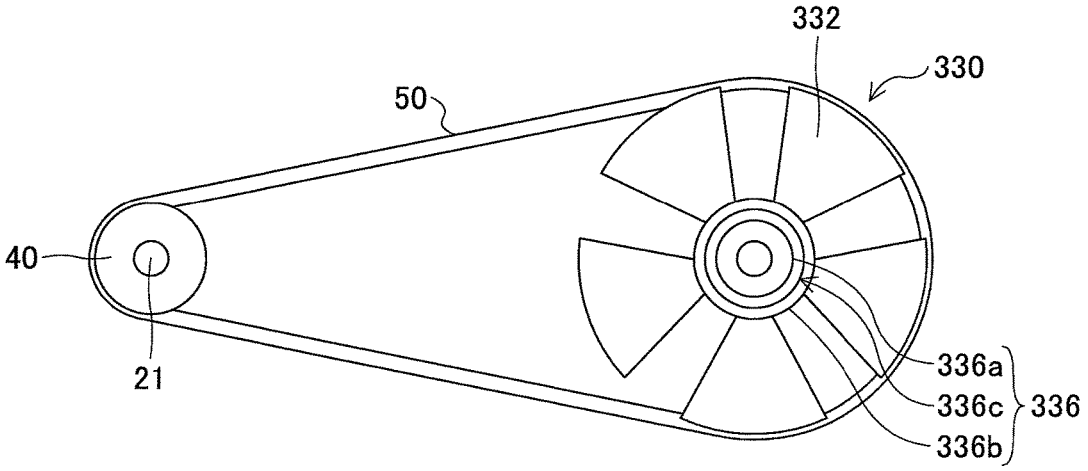
Figure 18A:
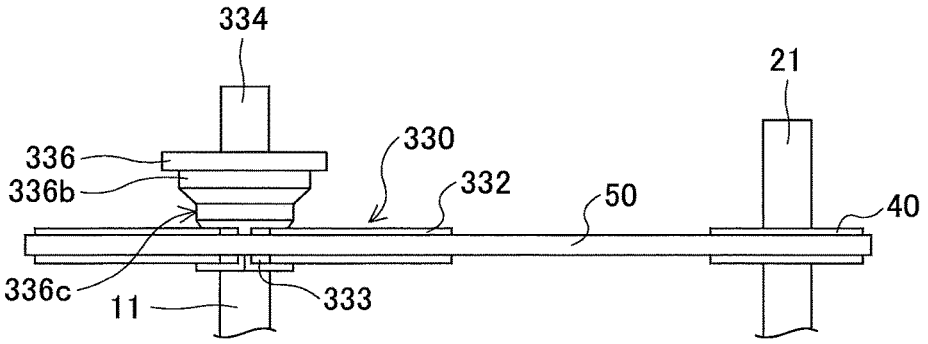
FIGS. 18A and 18B are diagrams depicting a pulley according to the fourth embodiment.
Figure 18B:
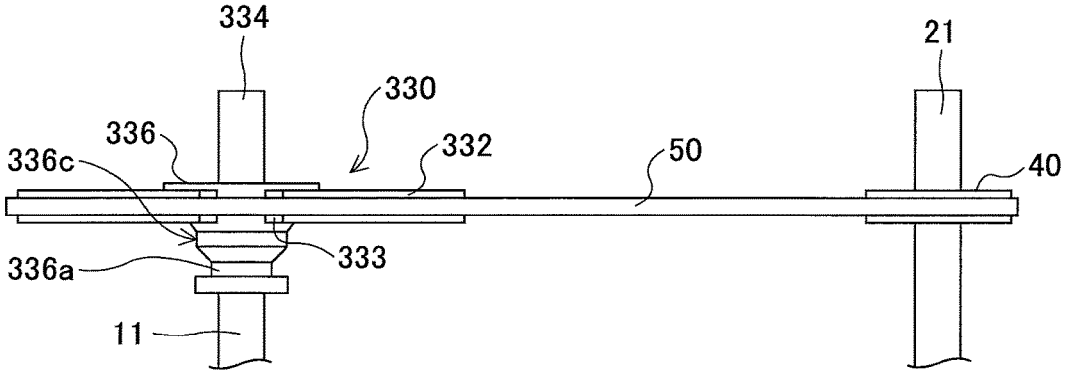

Next, a fourth embodiment is described. FIG. 16 is a perspective view of a printer according to this embodiment. FIGS. 17A and 17B are interior side views of the printer, taken from the side of the platen roller 10 and the motor 20. FIGS. 18A and 18B are bottom views of the printer including a first pulley 330.

Referring to FIG. 16, the printer includes the platen roller 10 and the motor 20. The first pulley 330 is attached to the shaft 11, and the second pulley 40 is attached to the shaft 21. The belt 50 is wrapped around the first pulley 330 and the second pulley 40, and when the motor 20 rotates, the second pulley 40 rotates to rotate the first pulley 330 via the belt 50, so that the platen roller 10 rotates.

The printer of this embodiment is described in more detail with reference to FIGS. 17A through 18B.

The first pulley 330 includes extension parts 332, an extension parts connecting part (hereinafter, "connecting part") 333, a push-button switch 334, and a changing member 336. Each of the extension parts 332 has a shape corresponding to one of sectorial parts into which a circular pulley is divided. In FIGS. 16 through 18B, each extension part 332 has a planar shape of an annular sector, corresponding to one of five sectors into which a circle is divided. The extension parts 332 are provided around and interconnected by the connecting part 333, which is formed of an elastic material, such as rubber.

The changing member 336 having the shape of a stack of disks 336*a* and 336*b* having different radii is provided at the center of the first pulley 330. The disk 336*a* is smaller in diameter than the disk 336*b*. The disks 336*a* and 336*b* are coaxially disposed one over the other, with the disk 336*a* being closer to the platen roller 10 than the disk 336*b*. The changing member 336 further includes a connecting portion 336*c* extending between the disks 336*a* and 336*b*. The diameter of the connecting portion 336*c* changes in its axial direction. The connecting portion 336*c* may have a tapered shape to have a diameter gradually decreasing toward the disk 336*a*. The periphery of the disk 336*a* or of the disk 336*b* contacts the inner edges of the extension parts 332. The changing member 336 is provided with the switch 334 to press the changing member 336 toward the platen roller 10.

According to this embodiment, when the switch 334 is not pressed, the periphery of the disk 336*a* contacts the inner edges of the extension parts 332 through the connecting part 333, so that the first pulley 330 has the smaller diameter, as depicted in FIGS. 17A and 18A.

In contrast, when the switch 334 is pressed, the changing member 336 is pressed by the switch 334 to move toward the platen roller 10, so that the periphery of the disk 336*b* contacts the inner edges of the extension parts 332 through the connecting part 333 to spread the extension parts 332 radially outward, as depicted in FIGS. 17B and 18B. As a result, the diameter of the first pulley 330 increases. When the switch 334 returns to its original state, the changing member 336 returns to its original state, so that the first pulley 330 has the smaller diameter, as depicted in FIG. 17A and FIG. 18A.

According to this embodiment, the conveying speed may be changed by changing the diameter of the first pulley 330 which is increased or decreased by the extension parts 332 when the switch 334 is pressed. The number of extension parts 332 may be, but are not limited to, five as depicted in FIGS. 16 through 18B. Preferably, the number of extension parts 332 is three or more. In other respects than those described above, the fourth embodiment may be the same as the first embodiment.

As a variation of the fourth embodiment, the changing member 336 may be configured so that a center of the connecting portion 336*c* where the diameter of the connecting portion 336*c* is constant serves as another disk that contacts the inner edges of the extension parts 332 to spread the extension parts 332 radially outward. In this case, the first pulley 330 may have three different diameters.

[e] Fifth Embodiment

Figure 19A:
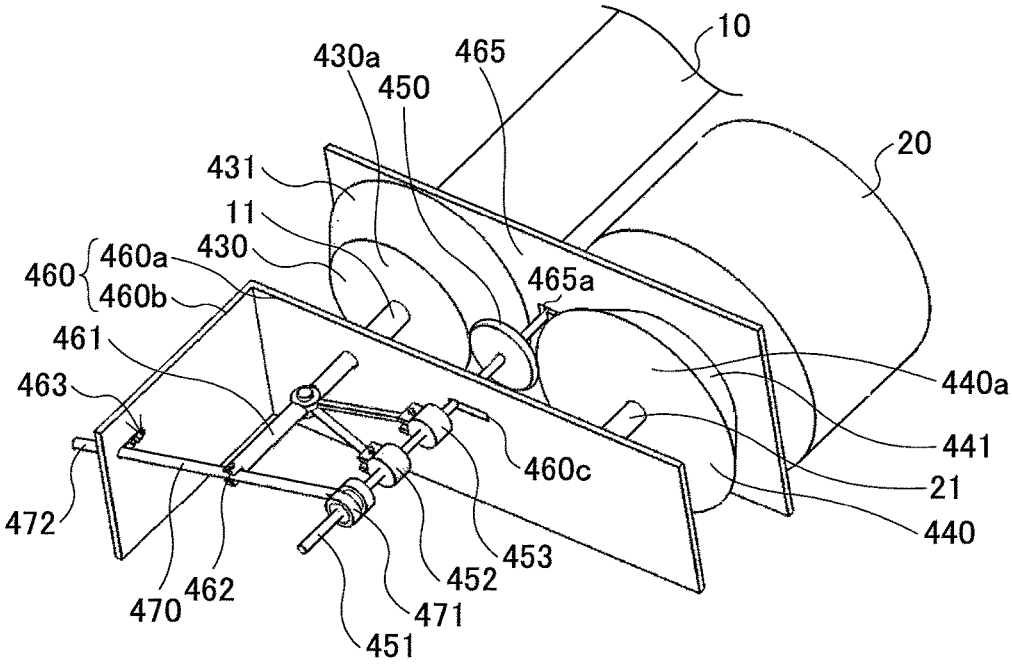
FIGS. 19A through 19C are diagrams depicting a printer according to a fifth embodiment.
Figure 19B:
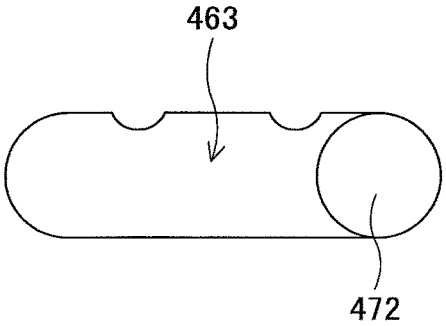
Figure 19C:
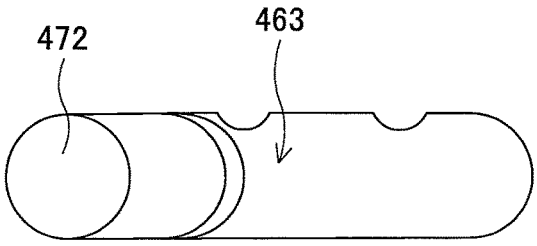
Figure 20:
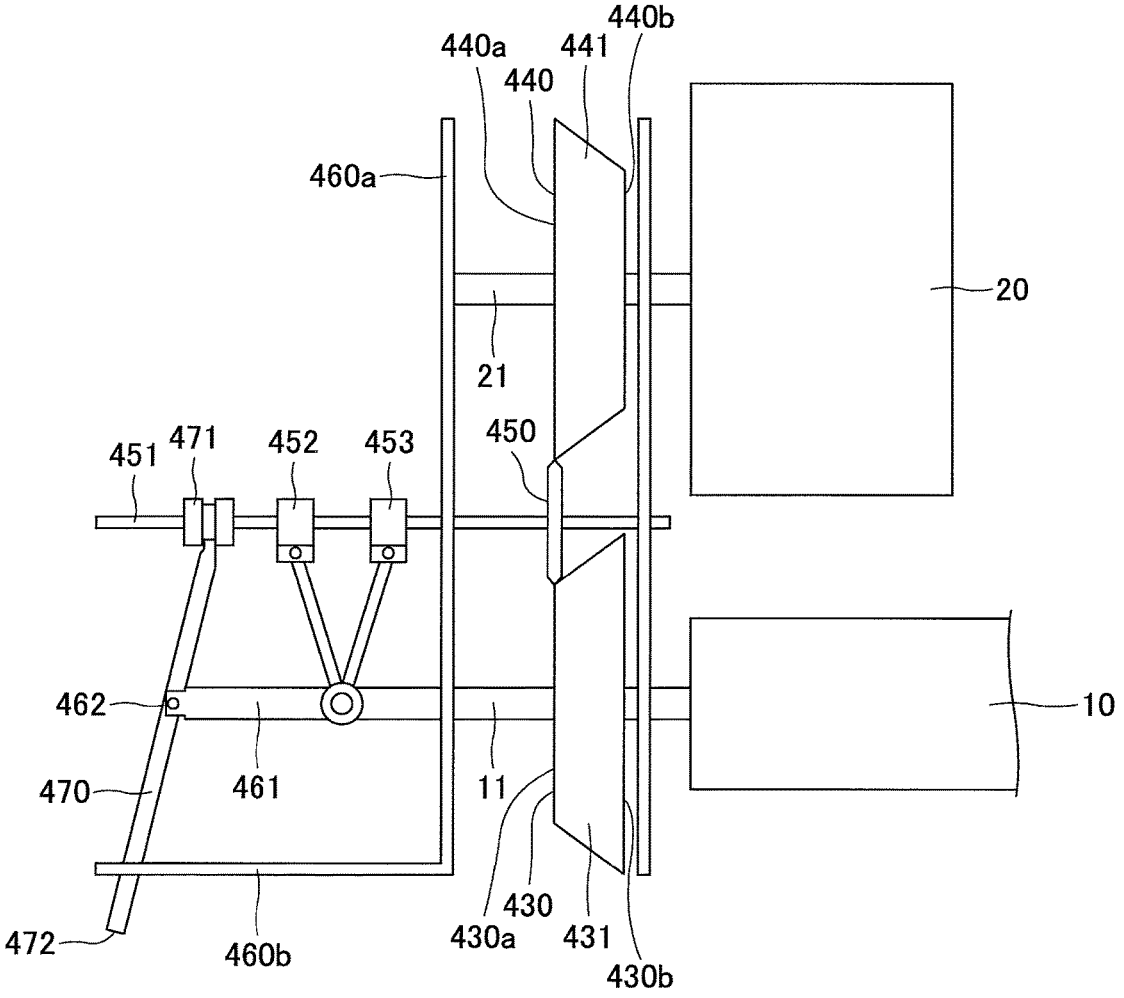
FIG. 20 is a diagram depicting the printer according to the fifth embodiment.
Figure 21:
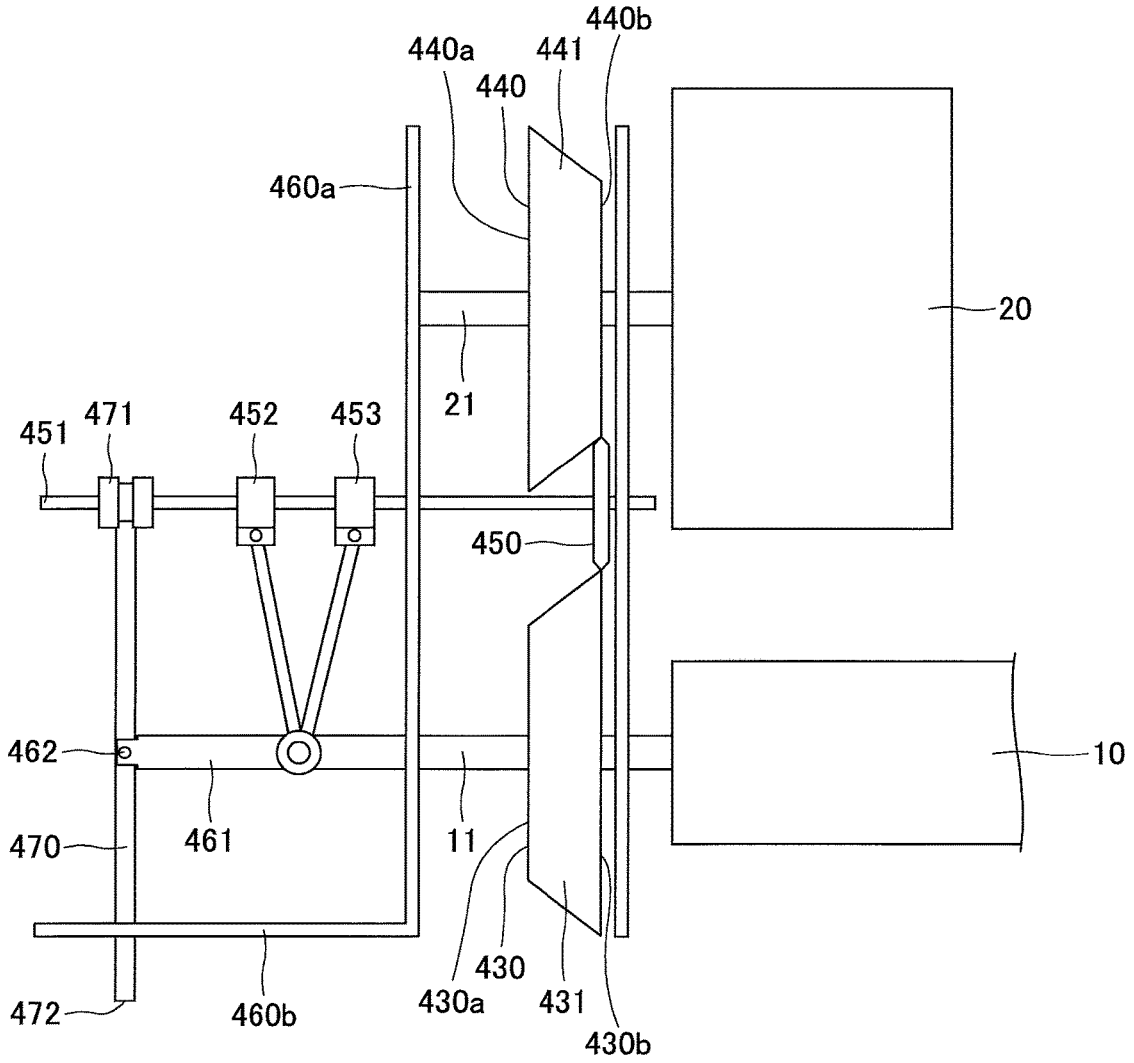
FIG. 21 is a diagram depicting the printer according to the fifth embodiment.

Next, a fifth embodiment is described. FIG. 19A is a perspective view of a printer according to this embodiment. FIGS. 19B and 19C illustrate positions of a lever 470. FIGS. 20 and 21 are bottom views of the printer.

Referring to FIG. 19A, the printer of this embodiment includes the platen roller 10, the motor 20, a first pulley 430 attached to the shaft 11 of the platen roller 10, a second pulley 440 attached to the shaft 21 of the motor 20, and a third pulley 450 disposed between the first pulley 430 and the second pulley 440. The periphery of the third pulley 450 contacts a periphery 431 of the first pulley 430 and a periphery 441 of the second pulley 440.

As depicted in FIGS. 19A through 21, the first pulley 430 is tapered in a direction away from the platen roller 10. That is, the periphery 431 of the first pulley 430 is sloped, so that the diameter of the first pulley 430 gradually increases in the direction from a first surface 430*a* to a second surface 430*b* of the first pulley 430. The second pulley 440 is tapered in a direction toward the motor 20. That is, the periphery 441 of the second pulley 440 is sloped, so that the diameter of the second pulley 440 gradually decreases in the direction from a first surface 440*a* to a second surface 440*b* of the second pulley 440. Accordingly, the periphery 431 of the first pulley 430 and the periphery 441 of the second pulley 440 are sloped in opposite directions at the same angle, so that the periphery of the third pulley 450 contacts both the periphery 431 and the periphery 441.

Accordingly, when the motor 20 rotates, the second pulley 440 rotates to rotate the third pulley 450 which is in contact with the second pulley 440. Consequently, the first pulley 430 in contact with the third pulley 450 rotates to rotate the platen roller 10.

A shaft 461 aligned with the axis of the platen roller 10 is provided through a cover 460, provided outside the first pulley 430 and the second pulley 440. The cover 460 is bent into an L shape, as depicted in FIGS. 20 and 21. The cover 460 includes a flat-plate first portion 460*a* extending parallel to the first surface 430*a* of the first pulley 430 and the first surface 440*a* of the second pulley 440, and a flat-plate second portion 460*b* extending outward from a longitudinal end of the first portion 460*a* in a direction away from the platen roller 10. The shaft 461 includes a connecting portion 462 formed at its first end. The connecting portion 462 is rotatably connected to the center of the lever 470. A second end of the shaft 461 is supported by the first portion 460*a*. A shaft 451, serving as the shaft of the third pulley 450, is provided through the first portion 460*a* to be rotatably connected to a connecting portion 471, provided at a first end of the lever 470. Furthermore, the shaft 451 is rotatably supported by supports 452 and 453 connected to the shaft 461. Furthermore, as depicted in FIG. 19A, a slit 460*c* laterally elongated in a direction in which the second pulley 440 and the third pulley 450 are arranged is formed in the first portion 460*a*. Furthermore, a slit 465*a* laterally elongated in the same direction as the slit 460*c* is formed in a wall 465 provided between the first and second pulleys 430 and 440 and the platen roller 10 and the stepper motor 20. The shaft 451 is inserted through the slits 460*c* and 465*a* to be laterally movable in the slits 460*c* and 465*a*. The lever 470 projects from the second portion 460*b* through an elongated opening 463 to have a second end 472 positioned outside the cover 460. Accordingly, it is possible to operate the lever 470 from outside the cover 460.

In FIG. 19A, the third pulley 450 contacts the first pulley 430 and the second pulley 440 at a position distant from the platen roller 10 and the motor 20, that is, on the first surface side of the first and second pulleys 430 and 440. In this state, as shown in FIG. 20, the periphery of the third pulley 450 contacts a small-diameter portion of the periphery 431 at which the diameter of the first pulley 430 is relatively small, and contacts a large-diameter portion of the periphery 441 at which the diameter of the second pulley 440 is relatively large. Accordingly, the rotation of the motor 20 is transmitted to the third pulley 450 through the large-diameter portion of the second pulley 440, and the rotation of the third pulley 450 is transmitted to the platen roller 10 through the small-diameter portion of the first pulley 430. In this state, as depicted in FIG. 19B, the second end 472 of the lever 470 is positioned on the right side in the opening 463, when viewed from outside the cover 460.

According to this embodiment, when the second end 472 of the lever 470 is moved leftward (rightward in FIG. 20) in the opening 463 as depicted in FIG. 19C, the lever 470 rotates counterclockwise on the connecting portion 462, serving as a point of support, from the state depicted in FIG. 20 to the state depicted in FIG. 21. As a result, the connecting portion 471 moves leftward along the shaft 451 as depicted in FIGS. 20 and 21. As the distance between the connection portions 462 and 471 does not change between the state depicted in FIG. 20 and the state depicted in FIG. 21, the shaft 451 is pressed by the lever 470 in a direction away from the shaft 461. As a result, the interval between the shaft 461 and the shaft 451 increases compared with the state of FIG. 20, so that the third pulley 450 contacting the first pulley 430 and the second pulley 440 moves toward the platen roller 10 and the motor 20 as the shaft 451 moves. Consequently, the third pulley 430 contacts the first pulley 430 and the second pulley 440 on the second surface side of the first and second pulleys 430 and 440.

In this state, the third pulley 450 contacts a large-diameter portion of the first pulley 430 and contacts a small-diameter portion of the second pulley 440. Accordingly, the rotation of the motor 20 is transmitted to the third pulley 450 through the second pulley 440 and the rotation of the third pulley 450 is transmitted to the platen roller 10 through the first pulley 430. Thus, it is possible to reduce the rotational speed of the platen roller 10 compared with the state of FIGS. 19A and 20, and it is possible to reduce the conveying speed. In other respects than those described above, the fifth embodiment may be the same as the first embodiment.

All examples and conditional language provided herein are intended for pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

What is claimed is:

1. A printer, comprising:
a platen roller;
a first pulley connected to a shaft of the platen roller;
a motor;
a second pulley connected to a shaft of the motor; and
a belt wrapped around the first pulley and the second pulley,
wherein at least one of the first pulley and the second pulley is configured to have a variable diameter, and
wherein the at least one of the first pulley and the second pulley includes
a frame;
extension parts provided on the frame; and
a push-button switch connected to the extension parts, and configured to be pressed to move the extension parts radially outward with respect to a center of the frame from a first position where the extension parts are in contact with a periphery of the frame to a second position where the extension parts are out of contact with the periphery of the frame.

2. The printer as claimed in claim 1, wherein
the at least one of the first pulley and the second pulley further includes
arms each having a first end connected to one of the extension parts,
the extension parts contact the belt, and
the push-button switch is connected to a second end of each of the arms, and configured to be pressed to move the arms to move the extension parts radially outward, so as to increase the diameter of the at least one of the first pulley and the second pulley.

3. The printer as claimed in claim 1, wherein
the at least one of the first pulley and the second pulley further includes
a dome provided in the center of the frame, wherein a periphery of the dome contacts the extensions parts,
the extension parts contact the belt, and
the push-button switch is configured to be pressed to press the dome to have the periphery of the dome spreading outward to press and move the extension parts radially outward, so as to increase the diameter of the at least one of the first pulley and the second pulley.

4. The printer as claimed in claim 1, wherein the push-button switch is configured to be pressed once to move the extension parts from the first position to the second position, and to be pressed again to move the extension parts from the second position to the first position.

5. A printer, comprising:
a platen roller;
a first pulley connected to a shaft of the platen roller;
a motor;
a second pulley connected to a shaft of the motor; and
a belt wrapped around the first pulley and the second pulley,
wherein at least one of the first pulley and the second pulley is configured to have a variable diameter, and
wherein the at least one of the first pulley and the second pulley includes
a frame;
extension parts provided on the frame to be radially movable with respect to a center of the frame, the extension parts contacting the belt;
a shaft configured to move in a direction of an axis of the frame;
first magnets each attached to one of the extension parts; and
a second magnet attached to the shaft,
wherein, as the shaft moves in the direction of the axis, the first and second magnets repel or attract each other to radially move the extension parts, so as to change the diameter of the at least one of the first pulley and the second pulley.

6. A printer, comprising:
a platen roller;
a first pulley connected to a shaft of the platen roller;
a motor;
a second pulley connected to a shaft of the motor; and
a belt wrapped around the first pulley and the second pulley,
wherein at least one of the first pulley and the second pulley is configured to have a variable diameter, and
wherein the at least one of the first pulley and the second pulley includes
a changing member including a plurality of disks having different diameters that are coaxially stacked one over another, and extension parts each having a shape of an annular sector, provided around the changing member and contacting the belt, wherein the changing member is configured to contact inner edges of the extension parts to radially move the extension parts relative to the changing member, so as to change the diameter of the at least one of the first pulley and the second pulley in accordance with the plurality of disks that contact the inner edges of the extension parts.

7. A printer, comprising:

a platen roller;

a first pulley connected to a shaft of the platen roller;

a motor;

a second pulley connected to a shaft of the motor;

a third pulley that contacts the first pulley and the second pulley; and a lever having a first longitudinal end to which a shaft of the third pulley is connected and a second longitudinal end opposite to the first longitudinal end, wherein a shaft aligned with an axis of the platen roller is connected to a center of the lever between the first longitudinal end and the second longitudinal end, the lever being configured to rotate on the center thereof to press the shaft of the third pulley in a direction away from the shaft aligned with the axis of the platen roller, so as to move the third pulley, when the lever is operated, wherein a periphery of the first pulley and a periphery of the second pulley are sloped to taper the first pulley and the second pulley in opposite axial directions, and the third pulley is configured to move on the sloped periphery of the first pulley and the sloped periphery of the second pulley, so as to change a rotational speed of the platen roller.

* * * * *